United States Patent [19]

Laganá et al.

[11] Patent Number: 4,983,187

[45] Date of Patent: Jan. 8, 1991

[54] METHOD FOR PREPARING A HIGH-CONCENTRATION SOLIDS SUSPENSION IN WATER

[75] Inventors: Vincenzo Laganá, Milan; Darió Ercolani; Elio Donati, both of Fano, all of Italy

[73] Assignee: Snamprogetti S.p.A., Milan, Italy

[21] Appl. No.: 293,092

[22] Filed: Jan. 3, 1989

[30] Foreign Application Priority Data

Jan. 21, 1988 [IT] Italy ..... 19143 A/88

[51] Int. Cl.[5] ..... C10L 9/10; C10L 1/32

[52] U.S. Cl. ..... 44/280; 44/622; 201/17

[58] Field of Search ..... 44/90, 622; 201/17

[56] References Cited

U.S. PATENT DOCUMENTS 4,217,109 8/1980 Siusersson et al. ..... 44/90
4,549,881 10/1985 Mathiesen et al. ..... 44/90
4,552,568 11/1985 Igarashi et al. ..... 44/90
4,783,197 11/1988 Mathiesen et al. ..... 44/90

*Primary Examiner*—Carl F. Dees
*Attorney, Agent, or Firm*—Oblon, Spivak, McClelland, Maier & Neustadt

[57] ABSTRACT

A method is described for preparing a high-concentration solids suspension, in particular coal or petroleum coke, which can be transported by pipe and be burnt with low emission of harmful substances, comprising crushing the solid to be suspended to a maximum particle size of 6 mm and then grinding it in the presence of additives in aqueous solution to a maximum solid particle size of 300 μm, the method being characterized by adding, either before the crushing or immediately before the grinding, a desulphurizer chosen from $CaCo_3$, $MgCO_3$ and dolomite, either alone or in mixture, in a molar ratio to the sulphur contained in the solid of between 1.5 and 3, and adding immediately before or during grinding a desulphurizer also possessing stabilizing and anticorrosive properties and chosen from MgO, $Mg(OH)_2$, CaO and $Ca(OH)_2$, either alone or in mixture, in a quantity of between 0.04 and 0.4% by weight of the final suspension.

9 Claims, No Drawings

METHOD FOR PREPARING A HIGH-CONCENTRATION SOLIDS SUSPENSION IN WATER

BACKGROUND OF THE INVENTION

1. Field of the Invention

This invention relates to a method for preparing a high-concentration solids suspension in water.

More particularly, the invention relates to a method which enables a high-concentration aqueous suspension of coal or petroleum coke to be obtained having the characteristic of low sulphur compound emission during combustion.

2. Discussion of the Background

It is well known that during oil or coal combustion sulphur contained in the fuel reacts with oxygen to form sulphur dioxide and sulphur trioxide, a minimum part being retained in the ash, depending on its alkalinity.

An increase in the capacity for absorbing sulphur and its oxides can be obtained by mixing with the fuel or injecting into the combustion chamber alkaline substances such as calcium and/or magnesium oxides, lime, dolomite etc.

The use of sorbents in controlling $SO_x$ emission in boilers fed with fossil fuel is a concept already applied in the past. In the U.S.A. up to the 1960's reductions of between 10 and 40% were obtained in sulphur emission by injecting lime or dolomite into boilers fed with powdered coal. The poor results obtained meant that this technology was considered unsuitable to play an important role in controlling pollutant gas emissions.

Recently however, the issuing by nearly all industrialised countries of more stringent laws regarding emissions has renewed interest in flame desulphurization and has led to various experimental trials both in the U.S.A. and in Europe which have enabled the critical parameters and characteristic quantities concerned in the process to be identified.

In particular, laboratory tests have confirmed the possibility of obtaining good $SO_x$ elimination efficiencies with reasonable Ca/S molar ratios ($SO_x$ reduction of 50–60% on untreated level using a Ca/S ratio of 2), both by flame desulphurization and by adding sorbents to the fuel.

The advantageous path for removing fuel inerts has also been followed in attempts at the cleaner use of coal. Unfortunately, although these methods offers considerable benefits in terms of drastic reduction in ash, sulphur removal reaches a maximum of only 50%, as the common beneficiation methods do not allow the removal of organic sulphur, which on the average represents 50% of the total sulphur present in the coal. Desulphurization methods can also be applied to coal-water mixtures, which have a known composition by weight of 60–75% of suitably ground coal plus 25–40% of water, together with fluidifying additives and if necessary stabilizers (to prevent sedimentation of the solid part) and anticorrosives.

In view of the more restrictive limits on sulphur emission, the application of desulphurization methods to slurries prepared either with coal as such or with beneficiated coal seems to be particularly suitable for satisfying such limits.

However, adding desulphurizers to water/coal or petroleum coke mixtures can negatively affect their rheological characteristics if they are not suitably chosen and metered.

SUMMARY OF THE INVENTION

We have now found that the use of an appropriate formulation of known desulphurizers added at determined points in the preparation of said mixtures solves the rheological problem of said mixtures while at the same time obtaining increased stabilizing and anticorrosive power.

The method of the present invention for preparing a solids suspension which can be transported by pipe and be burnt with low emission of harmful substances, comprising firstly crushing the solid to be suspended to a maximum particle size of 6 mm and then grinding it in the presence of additives in aqueous solution to a maximum particle size of 300 μm, is characterised by adding, either before the crushing or immediately before the grinding, a desulphurizer chosen from $CaCO_3$, $MgCO_3$ and dolomite, either alone or in mixture, in a molar ratio to the sulphur contained in the solid of between 1.5 and 3, and adding immediately before or during grinding a desulphurizer which also has stabilizing and anticorrosive properties and chosen from MgO, $Mg(OH)_2$, CaO and $Ca(OH)_2$, either alone or in mixture, in a quantity of between 0.04 and 0.4% by weight of the final suspension.

DETAILED DESCRIPTION OF THE PREFERRED EMBODIMENTS

A preferred manner of conducting the claimed method is to implement the grinding in two stages, possibly followed by mixing to optimize the rheological characteristics and stability of the product. The first of the two stages comprises micronizing part of the crushed solid in the presence of additives with a solid:-liquid weight ratio of between 35:65 and 60:40, whereas the second stage comprises the final grinding of the aqueous solid particles suspension from the first grinding stage and of that crushed solid which has not been micronized, with a weight ratio of micronized particles to non-micronized particles of between 20:80 and 50:50 on a dry basis.

In this case the desulphurizer (chosen from $CaCO_3$, $MgCO_3$ and dolomite, either alone or in mixture) is added before the crushing or immediately before the micronization stage, whereas the desulphurizer also possessing stabilizing and anticorrosive properties (chosen from MgO, $Mg(OH)_2$, CaO and $Ca(OH)_2$, either alone or in mixture) is added either immediately before the micronization or before the non-micronized crushed solid plus the micronized suspension of the first stage are ground in the second stage, or immediately before the possible mixing.

The final weight concentration of dry material in the suspension obtained by grinding in two stages varies preferably from 45 to 75%.

The desulphurizer is added with a particle size as near as possible to that of the solid to which it is added.

The desulphurizer also possessing stabilizing and anticorrosive properties can be added either in powder form or in aqueous suspension.

In particular, the suspended solid can be coal or petroleum coke. If the solid is coal, the quantity of desulphurizer possessing stabilizing and anticorrosive properties is preferably between 0.04 and 0.08% by weight of the final suspension.

If the solid is petroleum coke, the quantity of desulphurizer possessing stabilizing and anticorrosive properties is preferably between 0.08 and 0.4 % by weight of the final suspension.

The dispersing agents used can be preferably chosen from anionic dispersing agents (such as sulphonates) or non-ionic dispersing agents (such as ethoxylates or propoxylates of various organic substrates).

The additive quantity in the suspensions is generally between 0.1 and 1.5% by weight, and preferably between 0.3 and 0.7% by weight. A part of the desulphurizer (chosen from $CaCo_3$, $MgCO_3$ and dolomite, either alone or in mixture) can also be added immediately before combustion, preferably in aqueous suspension.

The method of the invention dispenses with the use of all those organic and inorganic chemicals used for static stabilization of the mixtures and for reducing corrosive activity.

Two examples are given hereinafter to better illustrate the invention, it being however understood that the invention is not limited to or by them.

EXAMPLE 1

A Polish coal having the following characteristics (analysis on dry basis):

| | |
|---|---|
| volatile substances | 30.2% by weight |
| ash | 9.9% by weight |
| sulphur | 0.74% by weight |
| higher calorific value | 7377 kcal/kg |
| grindability index (HGI) | 44 |

was used for the following test after crushing to obtain a product with a maximum particle size of 6 mm and a moisture content of 4.5%.

0.733 kg of crushed coal were fed to a micronizing mill (laboratory batch type) together with 0.939 kg of water to which 18 g of DAXAD 15, 108 g of $CaCO_3$ and 2.16 g of MgO had been added. The particle size distribution obtained showed a mean value of 7 μm and the mixture had a dry substance concentration of 46.3%. 0.636 kg of crushed coal were fed to a finishing rod mill (laboratory batch type) together with 0.706 kg of micronized product and 58 cc of water.

A suspension was obtained containing respectively 66,7% of dry substance and 63% of coal by weight. After final grinding the product was stirred and the suspension obtained was perfectly stable with time (more than 1 month) and flowable, with an effective viscosity of 1100–1300 mPa.s at 10 $s^{-1}$.

EXAMPLE 2

A petroleum coke having the following characteristics (analysis on dry basis):

| | |
|---|---|
| volatile substances | 12.94% by weight |
| ash | 1.06% by weight |
| sulphur | 4.07% by weight |
| higher calorific value | 8915 kcal/kg |
| grindability index (HGI) | 44 |

was used for the following test after crushing to obtain a product with a maximum particle size of 6 mm and a moisture content of 6.6%.

0.490 kg of crushed petroleum coke were fed to a micronizing mill (laboratory batch type) together with 0.886 kg of water to which 18 g of DAXAD 15, 396 g of $CaCO_3$ and 10.8 g of MgO had been added. The particle size distribution obtained showed a mean value of 7 μm and the mixture had a dry substance concentration of 50.8%. 0.682 kg of crushed petroleum coke were fed to a finishing rod mill (laboratory batch type) together with 0.703 kg of micronized product and 35 cc of water.

A suspension was obtained containing 70% of dry substance and 58.3% of petroleum coke. After final grinding the product was stirred and the suspension obtained was perfectly stable with time (more than 1 month) and flowable, with an effective viscosity of 700–800 mPa.s at 10 $s^{-1}$.

We claim:

1. A method for preparing a high-concentration coke or petcoke solids suspension in water which can be transported by pipe and burnt with low emission of harmful substances, comprising:

(i) crushing the solid to be suspended to a maximum particle size of 6 mm, and then (ii) wet-grinding the crushed solid in the presence of additives in aqueous solution to a maximum solid particle size of 300 μm;

wherein either before said crushing or immediately before said wet-grinding, a first desulphurizer which is one member selected from the group consisting of $CaCO_3$, $MgCO_3$, dolomite, and mixtures thereof is added, in a molar ratio relative to sulphur contained in said solid of between 1.5 and 3, and adding immediately before or during said wet-grinding a second desulphurizer which possesses stabilizing and anticorrosive properties and is one member selected from the group consisting of MgO, $Mg(OH)_2$, CaO, $Ca(OH)_2$, and mixtures thereof, in a quantity of between 0.04 and 0.4% by weight of the final suspension.

2. The method of claim 1, wherein said grinding, is effected in two stages: a first stage which comprises micronizing part of the crushed solid in the presence of a dispersing agent in an aqueous solution, using a solid:liquid weight ratio of between 35:65 and 60:40; and a second stage which comprises a final grinding of the aqueous solid particles suspension originating from said first grinding stage plus any crushed solid which has not been micronized, using a weight ratio of micronized particles to non-micronized particles of between 20:80 and 50:50 on a dry basis, said first desulphurizer being added either before said crushing or immediately before said micronization stage, said second desulphurizer which also possesses stabilizing and anticorrosive properties being added either immediately before said micronization stage or before said non-micronized crushed solid, and wherein said micronized suspension of said first stage are ground in said second stage.

3. The method of claim 1, wherein said grinding is followed by mixing, and is effected in two stages: a first stage which comprises micronizing part of the crushed solid in the presence of a dispersing agent in an aqueous solution, using a solid:liquid weight ratio of between 35:65 and 60:40; and a second stage which comprises a final grinding of the aqueous solid particles suspension originating from said first grinding stage plus any crushed solid which has not been micronized, using a weight ratio of micronized particles to non-micronized particles of between 20:80 and 50:50 on a dry basis, said first desulphurizer being added either before said crushing or immediately before said micronization stage, said second desulphurizer which also possesses stabilizing and anticorrosive properties being added either immediately before said micronization stage or before said non-micronized crushed solid, and wherein said micronized suspension of said first stage are ground in said second stage or immediately before said mixing.

4. The method of claim 1, wherein said solid is coal, and the quantity of said second desulphurizer also possessing stabilizing and anticorrosive properties used is between 0.04 and 0.08% by weight of the final suspension.

5. The method of claim 1, wherein said solid is petroleum coke and the quantity of said second desulphurizer also possessing stabilizing and anticorrosive properties used is between 0.08 and 0.4% by weight of the final suspension.

6. The method of claims 1, 2 or 3, wherein part of said first desulphurizer is added immediately before said combustion.

7. The method of claim 6, wherein part of said first desulphurizer is added in aqueous suspension immediately before said combustion.

8. The method of claim 3, wherein said solid is coke and the quantity of said second desulphurizer also possessing stabilizing and anticorrosive properties used is between 0.04 and 0.08% by weight of the final suspension.

9. The method of claim 3, wherein said solid is petroleum coke and the quantity of said second desulphurizer also possessing stabilizing and anticorrosive properties used is between 0.08 and 0.4% by weight of the final suspension.

* * * * *